US010888915B2

(12) United States Patent
Frenken et al.

(10) Patent No.: US 10,888,915 B2
(45) Date of Patent: Jan. 12, 2021

(54) DEVICE FOR APPLYING A PRESSING FORCE, AND A PAIR OF PRESSING JAWS

(71) Applicant: GUSTAV KLAUKE GMBH, Remscheid (DE)

(72) Inventors: Egbert Frenken, Heinsberg (DE); Roman Bobowicz, Remscheid (DE)

(73) Assignee: GUSTAV KLAUKE GMBH, Remscheid (DE)

( * ) Notice: Subject to any disclaimer, the term of this patent is extended or adjusted under 35 U.S.C. 154(b) by 355 days.

(21) Appl. No.: 15/751,045

(22) PCT Filed: Aug. 2, 2016

(86) PCT No.: PCT/EP2016/068373
§ 371 (c)(1),
(2) Date: Feb. 7, 2018

(87) PCT Pub. No.: WO2017/025379
PCT Pub. Date: Feb. 16, 2017

(65) Prior Publication Data

US 2018/0229290 A1 Aug. 16, 2018

(30) Foreign Application Priority Data

Aug. 10, 2015 (DE) ..... 10 2015 113 116
Nov. 16, 2015 (DE) ..... 10 2015 119 734

(51) Int. Cl.
*B21D 41/02* (2006.01)
*B25B 27/10* (2006.01)
(Continued)

(52) U.S. Cl.
CPC ..... *B21D 41/028* (2013.01); *B21D 41/02* (2013.01); *B25B 1/02* (2013.01); *B25B 1/20* (2013.01); *B25B 27/10* (2013.01); *B25B 1/2405* (2013.01)

(58) Field of Classification Search
CPC .... B21D 41/02; B21D 41/026; B21D 41/025; B21D 41/028; B21D 39/08; B21D 39/20; B25B 27/10; B25B 1/20; B25B 1/02
See application file for complete search history.

(56) References Cited

U.S. PATENT DOCUMENTS 4,890,472 A * 1/1990 Rothenberger ..... B21D 41/026 72/393
5,133,536 A 7/1992 Goodman
(Continued)

FOREIGN PATENT DOCUMENTS

AU 2009275488 A1 2/2010
CN 201271860 7/2009
(Continued)

OTHER PUBLICATIONS

EPO Machine translation of DE-202014104030-U1 (Year: 2020).*
(Continued)

*Primary Examiner* — Pradeep C Battula
(74) *Attorney, Agent, or Firm* — Klintworth & Rozenblat IP LLP

(57) ABSTRACT

The invention relates first to a device for applying a pressing force, comprising two pressing jaws (25, 26) which can be moved linearly relative to each other via a hydraulic piston-cylinder assembly (8). Additionally, an actuation cone (13) is provided for an expanding device (36), said cone carrying out a forward and rearward movement depending on an actuation of the hydraulic piston-cylinder assembly (8). In order to advantageously develop the device, the actuation cone (13) is connected to the hydraulic piston (9) of the hydraulic piston-cylinder assembly (8) for the forward and rearward movement. The invention further relates to a device for applying a pressing force, comprising two pressing jaws which can be moved linearly relative to each other
(Continued)

and which can be held in receiving areas and to a pair of pressing jaws.

14 Claims, 9 Drawing Sheets

(51) Int. Cl.

| | |
|---|---|
| ***B25B 1/20*** | (2006.01) |
| ***B25B 1/02*** | (2006.01) |
| *B25B 1/24* | (2006.01) |

(56) References Cited

U.S. PATENT DOCUMENTS

| | | | | |
|---|---|---|---|---|
| 6,145,641 | A | 11/2000 | Adachi et al. | |
| 6,206,772 | B1 | 3/2001 | Davis | |
| 6,415,641 | B1 | 7/2002 | Wagner | |
| 6,619,099 | B2 * | 9/2003 | Barjesteh | B21D 41/02 72/393 |
| 6,862,766 | B2 * | 3/2005 | Geurts | B21D 41/026 29/268 |
| 7,412,868 | B2 | 8/2008 | Frenken | |
| 9,586,310 | B2 | 3/2017 | Sapper et al. | |
| 9,694,410 | B1 * | 7/2017 | Huang | B21D 41/021 |
| 9,808,852 | B2 * | 11/2017 | Frenken | B21D 41/028 |
| 9,987,672 | B2 * | 6/2018 | Houle | B21D 41/02 |
| 10,406,586 | B2 * | 9/2019 | Frenken | B21D 39/20 |
| 10,468,847 | B2 * | 11/2019 | Frenken | H01R 3/048 |
| 2003/0204943 | A1 | 11/2003 | Geurts | |
| 2009/0008118 | A1 | 1/2009 | Frenken | |
| 2011/0219594 | A1 | 9/2011 | Kaufmann | |
| 2015/0336250 | A1 | 11/2015 | Sapper et al. | |
| 2018/0161845 | A1 * | 6/2018 | Ulrich | B21D 41/026 |

FOREIGN PATENT DOCUMENTS

| | | | | |
|---|---|---|---|---|
| DE | 202088010080 | U1 | 1/2010 | |
| DE | 202014104030 | U1 * | 12/2015 | B21D 39/04 |
| EP | 1055488 | A2 | 11/2000 | |
| EP | 1406358 | | 4/2004 | |
| EP | 2011605 | | 1/2009 | |
| GB | 113321 | | 2/1918 | |
| WO | 2003/084719 | A2 | 10/2003 | |
| WO | 2010/040812 | | 4/2010 | |
| WO | WO-2014049035 | A1 * | 4/2014 | B21D 39/20 |
| WO | 2014/086464 | A1 | 6/2014 | |
| WO | 2015/185201 | | 12/2015 | |

OTHER PUBLICATIONS

International Search Report for corresponding International Patent Application No. PCT/EP2016/068373 dated Nov. 4, 2016, 5 pages.
Written Opinion for corresponding International Patent Application No. PCT/EP2016/068373 dated Nov. 4, 2016, 7 pages.
CN 201271860Y English machine translation.
EP 1055488A2 English machine translation.
EP 1406358A1 English machine translation.
EP 2011605A2 English machine translation.
WO 2010/040812A1 English machine translation.
WO 2015/185201A1 English machine translation.
English Machine Translation of AU 2009275488 A1.
English Machine Translation of DE 202088010080 U1.

* cited by examiner

DEVICE FOR APPLYING A PRESSING FORCE, AND A PAIR OF PRESSING JAWS

AREA OF TECHNOLOGY

The invention initially relates to a device for applying a pressing force, with two pressing jaws that can be moved linearly relative to each other via a hydraulic piston-cylinder assembly, wherein an actuation cone is further provided for an expanding device, and performs a forward and backward movement depending on the actuation of the hydraulic piston-cylinder assembly.

Such a device is used in particular for compressing pipes, in particular axially compressing pipes. In such an application, but even independently thereof, it may be necessary to (initially) expand the end of a pipe section to be compressed. For this purpose, an expanding device can be arranged on the device, which can be acted upon by an actuation cone on the device side.

PRIOR ART

For example, such a device is known from WO 2014/086464 A1 (US 2015/0336250 A1). Such a device is also referred to as a sliding jaw tool.

SUMMARY OF THE INVENTION

As regards known prior art, the object of the invention is to indicate an advantageous device of the kind in question.

In a potential solution to the object provided according to a first inventive idea, the aim is to connect the actuation cone with the hydraulic piston of the hydraulic piston-cylinder assembly for the forward and backward movement.

This makes it possible to achieve a compact structural design for the device. The actuation cone is connected with the hydraulic piston for its displacement. At the same time, this hydraulic piston can bring about the displacement of at least one pressing jaw when using the device for axially compressing pipes. As also preferred, the actuation cone can be mechanically joined directly with the hydraulic piston.

Additional features of the invention are described below, to include the description of the figures, often as preferably allocated to the subject matter of claim 1 or to features in additional claims. However, they can also be significant as allocated to only individual features of claim 1 or the respective additional claim, or each independently.

It can further be provided that the hydraulic piston-cylinder assembly be part of an attachment that can be hooked up to a base device for hydraulic supply purposes. The base device is designed to supply the attachment with hydraulic fluid, as well as to build up a hydraulic pressure required for using the attachment. To this end, the base device can have a pump, which pumps hydraulic fluid out of a hydraulic storage reservoir in the base device into a hydraulic line, wherein the hydraulic fluid acts on the hydraulic piston of the hydraulic piston-cylinder assembly of the attachment. For example, such a base device is known from WO 2003/084719 A2 (U.S. Pat. No. 7,412,868 B2).

The hydraulic piston-cylinder assembly can be secured to a mounting stud, wherein the mounting stud can be used to arrange the attachment on the base device.

At the same time, the mounting stud can have a hydraulic line for supplying the hydraulic piston-cylinder assembly. A configuration in which the hydraulic line centrally penetrates through the mounting stud in the direction of extension of the stud axis here proves advantageous. The hydraulic line establishes the hydraulic connection between the piston-cylinder assembly in the attachment and the base device.

The hydraulic piston-cylinder assembly together with the pressing jaw and/or actuation cone can be rotatably arranged around the mounting stud. Preferred in this regard is a stop-limited rotatability measuring up to 180 degrees or more, further for example up to 350 degrees. Also possible in this regard are complete and potentially multiple rotations around the axis of the mounting stud. Individual rotational latching positions can also be provided, for example in 15 degree or 30 degree angular increments. This makes the device easy to handle.

In a possible embodiment, the hydraulic piston of the hydraulic piston-cylinder assembly can be fixed in place relative to the mounting stud and/or base device while activating the hydraulic piston-cylinder assembly. In this case, the cylinder is displaced relative to the fixed hydraulic piston, in particular linearly displaced, given an activation, i.e., while pumping hydraulic fluid into the working area of the piston-cylinder assembly.

The actuation cone can also be fixed in place relative to the mounting stud and/or base device while activating the hydraulic piston-cylinder assembly. A displacement of the cylinder of the piston-cylinder assembly relative to the actuation cone during a hydraulic activation of the device is preferable in this conjunction as well.

The expanding device is here preferably secured to the displaceable part of the device, in particular to the cylinder, so that the expanding device can be displaced together with the cylinder relative to the actuation cone during a hydraulic activation. In the course of this displacement, the actuation cone acts on the expanding device to expand a pipe end or the like.

In another preferred embodiment, the actuation cone extends concentrically to an elongated geometric hydraulic piston axis. The actuation cone can thus in any event further extend over a portion of its longitudinal extension inside of the cylinder of the piston-cylinder assembly.

A piston head of the hydraulic piston exposed to hydraulic fluid during an activation can be arranged opposite a free tip of the actuation cone with respect to a longitudinal extension of the hydraulic piston in the displacement direction of the hydraulic cylinder of the hydraulic piston-cylinder assembly. In this way, an assembly can here be obtained in which, with respect to the mounting stud and/or the hydraulic line penetrating through the mounting stud, and further with respect in particular to a mounting stud axis around which the device can be rotated, the hydraulic piston, in a cross section through the device in which both the mounting stud axis and hydraulic piston axis are represented by lines in a plane running parallel to the drawing plane, extends directed essentially transversely to the mounting stud axis, roughly proceeding from the mounting stud, while the actuation cone extends opposite to the hydraulic piston with respect to the mounting stud axis.

In a preferred embodiment, both the piston head and tip of the actuation cone each face oppositely radially outward with respect to the mounting stud axis.

In a possible embodiment, the actuation cone is operatively non-detachably mounted in the device, e.g., joined directly with the hydraulic piston, e.g., bolted, crimped or welded, e.g., further designed integrally with the latter.

By contrast, the actuation cone is detachably arranged in the device by way of a latching retainer in a preferred embodiment. This makes it possible to individually arrange an actuation cone in the device. For example, the actuation cone can be removed when using the device purely as an axial pressing device. In addition, various actuation cones can be provided to the device, e.g., with varyingly steep conical surfaces. Removing the actuation cone leaves the hydraulic piston and/or hydraulic cylinder untouched, at any rate as relates to the parts essential for executing a compression process.

The preferred latching retainer of the actuation cone in the device can be released by the user without any tools. Furthermore, the latching position can be found just by displacing the actuation cone toward the latching position, e.g., by correspondingly configuring the converging flanks of the actuation cone and latching retainer during an insertion motion, which results in an evasive movement by the latching retainer.

A return spring can be provided for restoring the hydraulic piston-cylinder assembly. A cylindrical spring can be involved here, in particular a compression spring, but also a tension spring.

In a preferred embodiment, the actuation cone extends at least over a portion of its longitudinal extension inside of the return spring, correspondingly enveloped by the latter. In an embodiment of the return spring as a compression spring, in particular a cylindrical compression spring, the latter can be tensioned between the cylinder of the piston-cylinder assembly and the mounting stud that is fixed in place relative to the cylinder. The assembly can be concentric to an elongation of the piston axis. The return spring serves to restore the hydraulic piston relative to a fixed hydraulic cylinder or, as preferred, to restore the movable hydraulic cylinder relative to the fixed hydraulic piston after performing a compression.

In another embodiment, the actuation cone can have a two-part design, wherein a first part is a mounting foot part, and a second part has the conical surface. The mounting foot part and the second part having the conical surface are joined together for using the actuation cone, e.g. by creating a plug-in or latching retainer. Among other things, this makes it possible to make the two parts out of different materials, and also to fit a mounting foot part with various second parts.

The invention further relates to a device for applying a pressing force with two pressing jaws that can move linearly relative to each other and be held in a receiving area.

For example, such devices are known as so-called axial pressing devices for pipes or the like.

As relates to prior art, the object of the invention is to further improve a device of the kind in question with respect to its advantages in use.

In another inventive idea, a possible solution to the object involves a device in which the aim is to provide three receiving areas for pressing jaws arranged linearly one behind the other.

Of the three receiving areas, preferably only two are fitted with pressing jaws for purposes of axial pressing. The arrangement of three pressing jaw receiving areas makes it possible to also process excess lengths over a two-stage process by placing one of the pressing jaws into the other receiving area after a first procedural step so as to complete the pressing process thereafter.

Two receiving areas for pressing jaws can be arranged linearly one behind the other on a fixed housing section of the device, and one receiving area on a hydraulic cylinder that receives a hydraulic piston of a piston-cylinder assembly. The hydraulic cylinder with its receiving area can be displaceable relative to the hydraulic piston. The two additional receiving areas for a pressing jaw are preferably fixed in place relative to the receiving area of the hydraulic cylinder, so that during use of the device, the pressing jaw of the hydraulic cylinder arranged in the one receiving area is displaced in an axial direction of the hydraulic piston or hydraulic cylinder on the fixed pressing jaw.

The invention also relates to a pair of pressing jaws, for example which are designed for latching retention on an attachment for pushing compression.

Pressing jaws of the kind in question are known, in particular in conjunction with devices as previously described.

The object of the invention is to indicate an advantageous pair of pressing jaws.

One possible solution to the object involves a pair of pressing jaws, in which the pressing jaws are joined together to limit any movement apart in the mounted state.

The pressing jaws can preferably be arranged on a device of the kind described above, correspondingly on a device for axially pressing pipes or the like. After pressing is complete, in the process of which the pressing jaws are displaced toward each other in an axial direction, the pressing jaws are displaced in the opposite direction toward an initial position. This return displacement path is limited by the connected pressing jaws, so that a maximum clearance arises between the pressing jaws, preferably adjusted to the pressing jaw size. By contrast, the potential return displacement path without the mentioned connected pressing jaws, for example owing to the ability to restore a hydraulic piston relative to a hydraulic cylinder, is as a rule larger.

Once the return position stop-limited by the connection has been reached, a next pressing process can be started immediately. There is no need for a return displacement into an initial position defined by the pressing device that potentially goes beyond the required spacing between the pressing jaws.

In a hydraulically actuatable device, in particular with an automatically closing return valve according to the WO 2003/084719 A2 mentioned at the outset, once the stop-limited return position of the pressing jaws given by the connection has been reached, the return valve moves into its closed position, and the next pushing compression process can be implemented proceeding from this position. Even given just an electromechanical device, a stop position can be detected during a return movement, for example by acquiring an elevated motor current, after which the device switches over into a pressing standby position, potentially automatically.

The connection can be provided by a flexible connecting element. Such a flexible connecting element can be a chain, a flexible cable or further a flexible (slack) plastic rope, for example, but which cannot be elongated.

In addition, the connection can also take the form of a rod. The latter can extend strictly linearly in the displacement direction of at least one pressing jaw, wherein the rod is fastened to a pressing jaw, and, for example, penetrates through the other pressing jaw with an end lying opposite this pressing jaw. For example, a thickened area of the rod provided at the end comprises the stop limit during a return. The rod can be a wire. A bracket-shaped rod can also be provided, which is secured to a pressing jaw and engages the other pressing jaw from behind like a bracket.

Another embodiment provides that the pressing jaws are not connected when in a removed state. In this case, the latter are present as individual parts. As a result, the connection can be released by the user, if necessary using a conventional tool. Also conceivable in this regard is a release without a tool. For example, a chain or the like can be suspended from a pressing jaw, or a rod fixedly connected to a pressing jaw can be pulled out via a groove pattern formed on the other pressing jaw.

In addition, the pressing jaws can remain connected when removed, so that they are always present as a matching pair. As a result, the pressing jaws can also be oriented, so that they cannot be erroneously used individually.

If the connection is designed as a wire elongated in the use state, the latter can, if potentially bent (e.g., with the pressing jaw pair in the removed state), be easily bent back by the user again. The wire offers enough flexibility for this purpose. Nonetheless, the connection is solid and largely rigid.

The features in the independent claims described above are significant whether taken individually or in any combination with each other, wherein the features of one independent claim can further be combined with the features of another independent claim or with features of several independent claims, or also with only individual features of one or several of the other independent claims.

BRIEF DESCRIPTION OF THE DRAWINGS

While the invention is explained below based on the attached drawings, the latter only present exemplary embodiments. A part that is described only with reference to one of the exemplary embodiments and not replaced by another part in a further exemplary embodiment due to the features highlighted therein is thus also described for this further exemplary embodiment as an at any rate possibly present part. The drawing shows:

FIG. 7 An illustration corresponding to FIG. 6 relating to an alternative configuration, in which the pressing jaws are connected by a rod;

DESCRIPTION OF THE EMBODIMENTS

Figure 1:
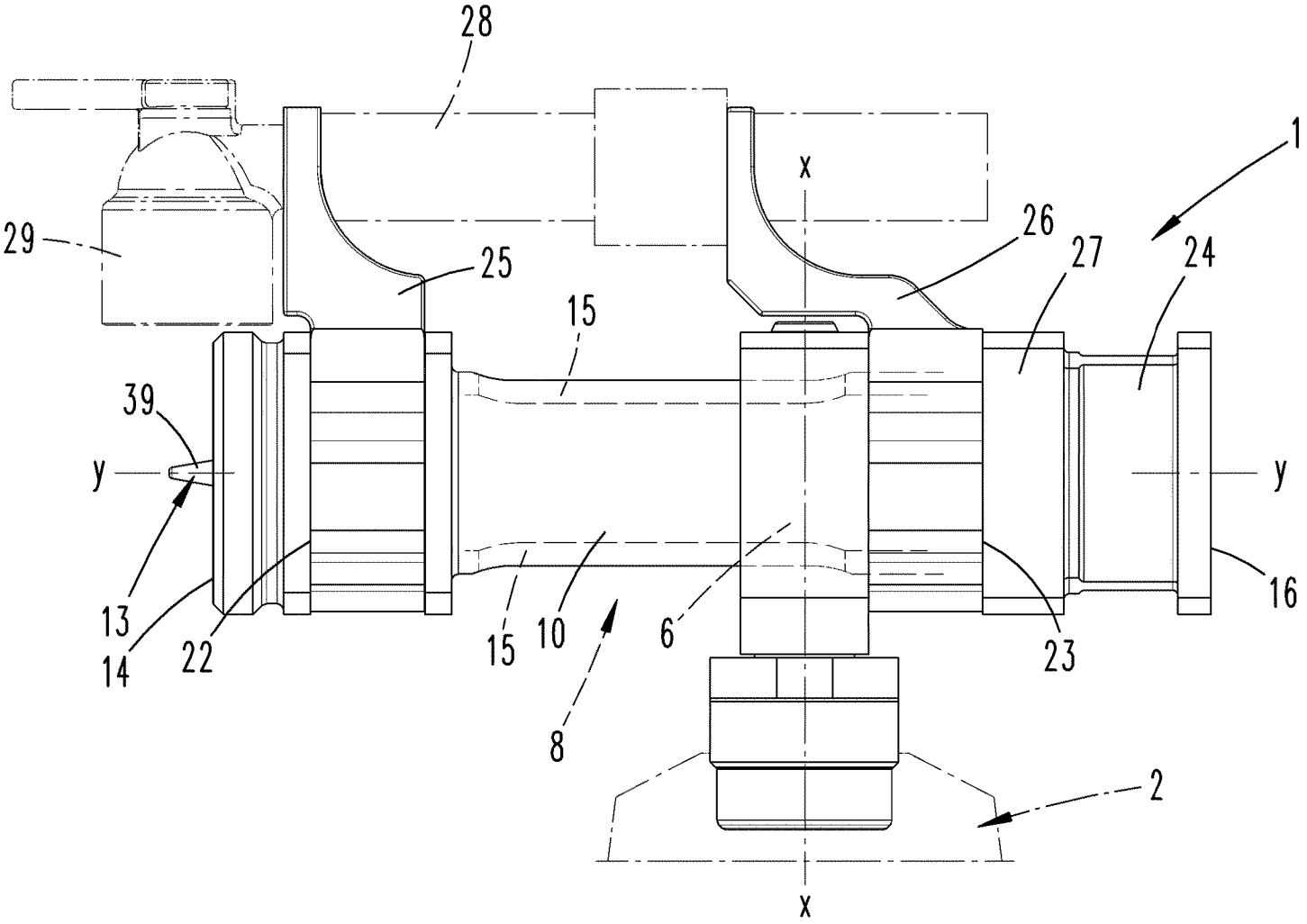
FIG. 1 An elevation view of an attachment connected to the base device in a configuration for axially compressing pipe parts.

A device for applying a pressing force is initially shown and described with reference to FIGS. 1 to 4, which essentially consists of an attachment 1 and a base device 2 that can be connected to the attachment for hydraulic supply purposes.

As also preferred, the hydraulic base device 2 can involve a base device, as also shown and described in the WO 2003/084719 A2 (U.S. Pat. No. 7,412,868 B2) cited at the outset. For example, with reference to FIG. 4, the connection with the subject matter described in the mentioned WO publication is correspondingly visible in the upper area of the base device 2 in the form of a return valve 3, a tank 4 and a pumping plunger 5. Otherwise, reference is made the mentioned WO or US publication in its entirety by way of further explaining the hydraulic base device 2 preferably used here, including for purposes of also incorporating features described in the WO or US publication concerning the structural design of the device into claims of this application.

The attachment 1 is both mechanically and hydraulically connected with the base device 2 by a mounting stud 6. To this end, the mounting stud 6 is initially designed to be screwed to the base device 2.

The mounting stud 6 extends concentrically around a stud the x axis, along which a hydraulic line 7 further runs in the mounting stud 6 for supplying a hydraulic piston-cylinder assembly 8 of the attachment 1.

Figure 2:
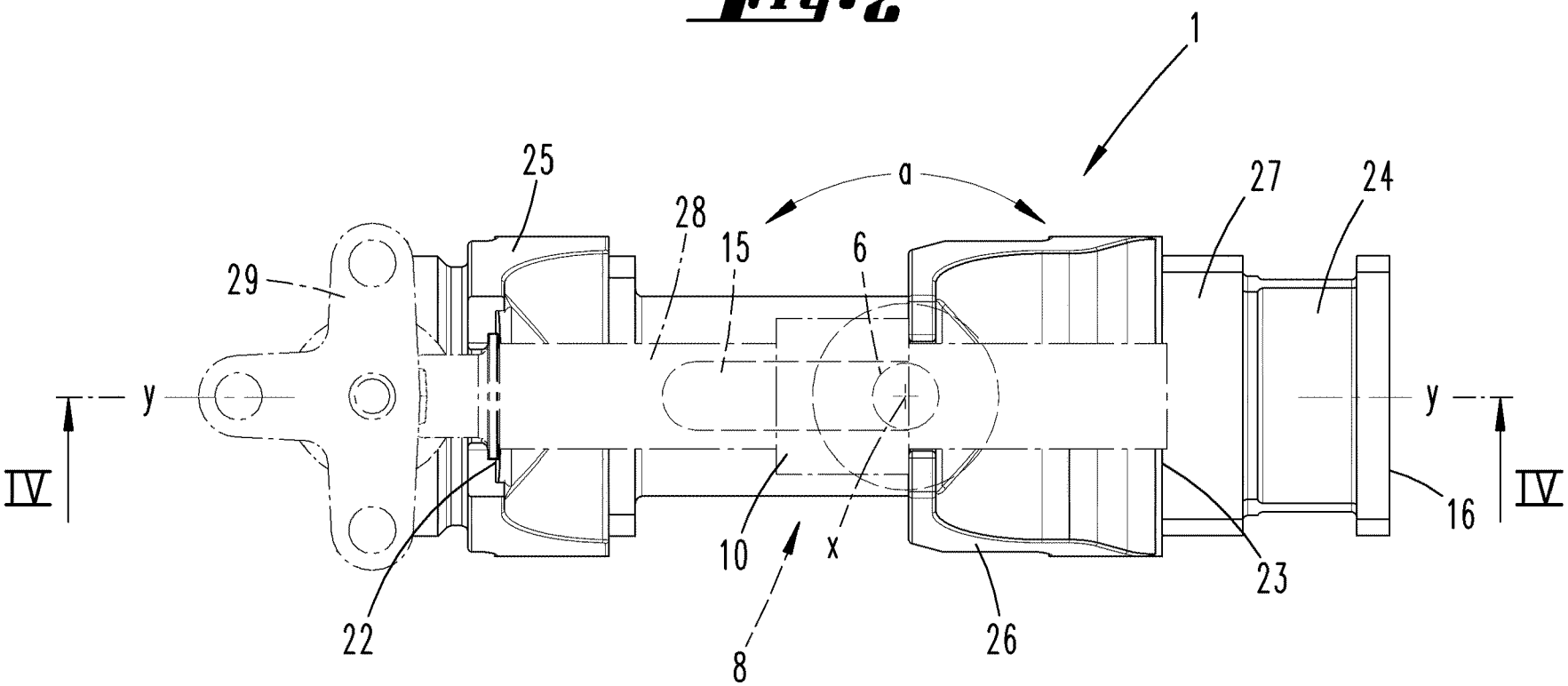
FIG. 2 The top view thereof.
Figure 3:
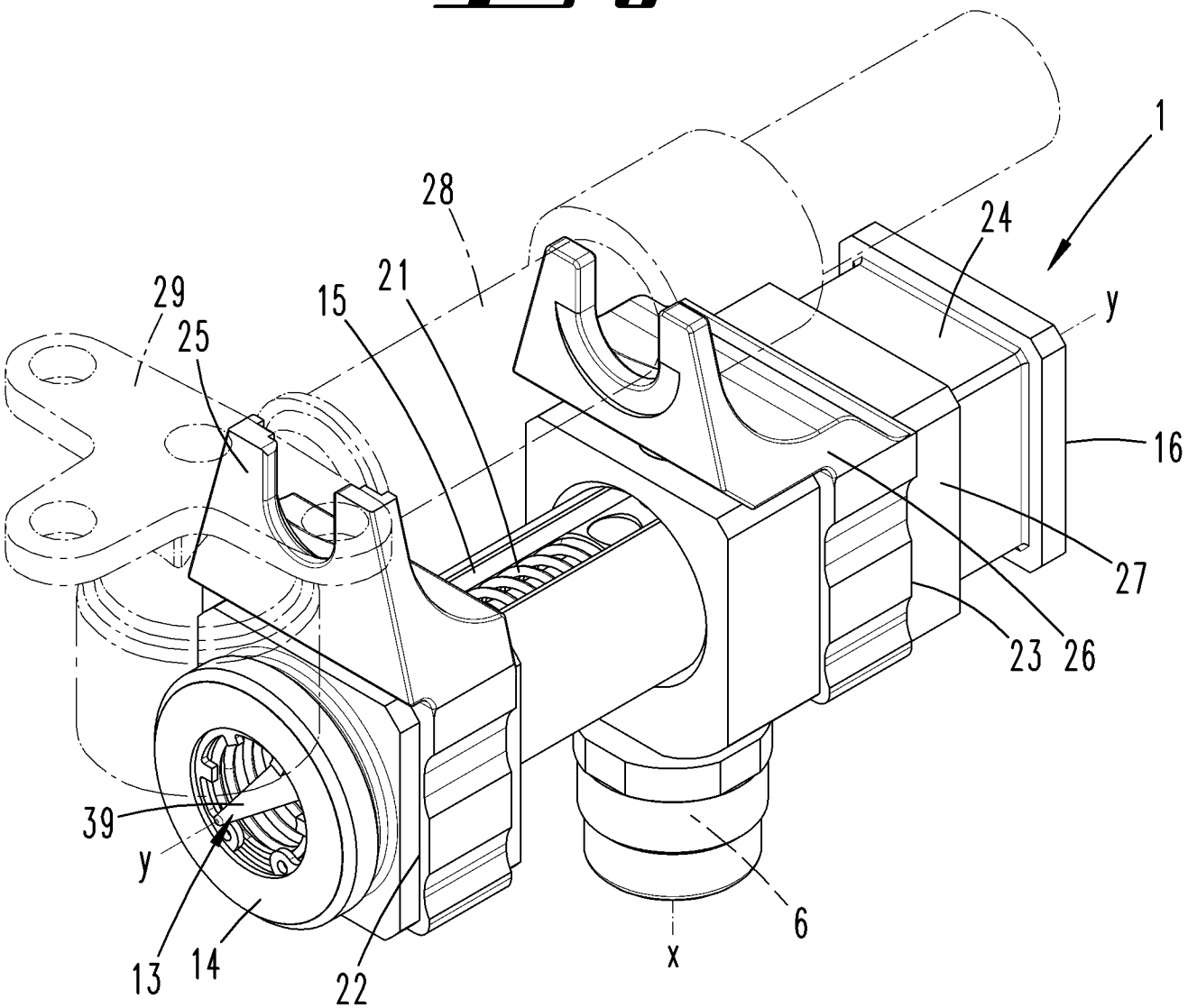
FIG. 3 A perspective view of the attachment.

The piston-cylinder assembly 8 is retained on the mounting stud so it can rotate around the stud the x axis (see arrow a on FIG. 2). Individual rotational latching positions can be provided.

Hydraulic pistons 9 and hydraulic cylinders 10 of the piston-cylinder assembly 8 extend transversely directed to the stud the x axis with respect to the geometric the y axis that intersects the hydraulic piston 9 and/or hydraulic cylinder 10 in the longitudinal direction, i.e., preferably are radially oriented with respect to the stud the x axis.

Figure 4:
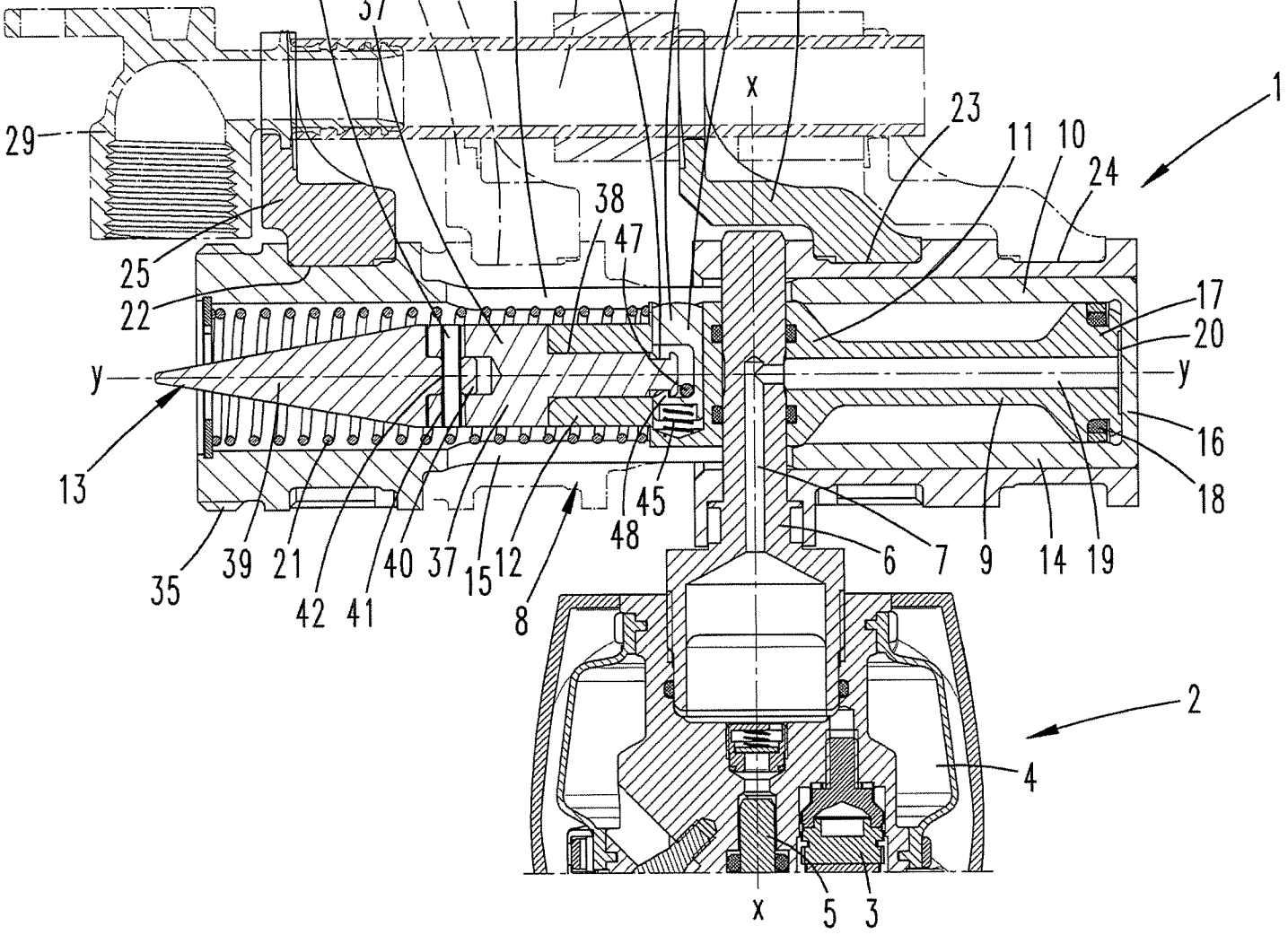
FIG. 4 The section according to line IV-IV on FIG. 2.

The hydraulic piston 9 is fixedly arranged in a hub 11 encompassing the mounting stud 6, and as regards its area that interacts with the hydraulic cylinder 10 extends unilaterally to the hub 11 with respect to stud the x axis, for example with reference to the view on FIG. 4.

With reference to a cross section through the mounting stud 6 and hub 11 transverse to the stud the x axis, a mounting section 12 for an actuation cone 13 is formed on the hub 11 essentially diagonally opposite the hydraulic piston 9.

The hydraulic piston 9, hub 11, mounting section 12 and/or actuation cone 13 are overlapped by the hydraulic cylinder 10. The latter is shaped essentially rotationally symmetrical to the y axis, as are preferably the hydraulic piston 9, hub 11, mounting section 12 and/or actuation cone 13 as well.

The hydraulic cylinder 10 has a continuous cylinder wall 14 with two opposing longitudinal slots 15 that extend in the direction of extension of the y axis. When activating the device, the longitudinal slots 15 can be traversed by the mounting stud 6, or make it possible to displace the hydraulic cylinder relative to the fixed mounting stud 6.

The section of the hydraulic cylinder 10 that flashes the hydraulic piston 9 is provided with a cylinder floor 16 that runs transverse to the extension of the y axis. The piston head 17 of the hydraulic piston 9 is formed opposite the latter on the interior side of the wall, and together with a gasket 18 running around the y axis acts against the interior side of the cylinder wall 14.

The hydraulic piston 9 is run through by a line 19 formed concentrically to the y axis, whose one end is connected with the hydraulic line 7 of the mounting stud 6 and via the latter with the base device 2, and whose other end in the piston head 17 empties into the pressure chamber 20 between the piston head 17 and cylinder floor 16.

Pumping hydraulic fluid into the pressure chamber by activating the base device 2 leads to a linear displacement of the hydraulic cylinder 10 along the y axis relative to the fixed hydraulic piston 9. The length of the longitudinal slots 15 here provides a potential stop limit.

A return to the basic position exemplarily shown on FIG. 4 can be effected by a spring force. To this end, a return spring 21 in the form of a cylinder compression spring can be provided, which is clamped opposite the hydraulic piston 9 between the mounting section 12 and the end of the hydraulic cylinder 10 facing away from the cylinder floor 16.

Two or three receiving areas 22, 23, 24 for pressing jaws 25, 26 are provided on the attachment 1, arranged linearly one after the other in relation to the x axis. The receiving areas 23, 24 are here formed on the exterior wall side of a housing section 27 that is fixed on the mounting stud 6 and partially envelops the hydraulic cylinder 10 over its length. This housing section 27 consists of the section of the hydraulic cylinder 10 that envelops the hydraulic piston in the basic position according to FIG. 4, preferably proceeding from the stud the x axis and correspondingly extending in the opposite direction toward the free end area of the hydraulic cylinder 10. In this free end area of the hydraulic cylinder 10, the receiving area 22 is formed on the exterior side of the wall.

Accordingly, the pressing jaw 25 allocated to the receiving area 22 is a linearly movable pressing jaw, while the pressing jaw 26 allocated to the receiving area 23 or 24 is a fixed jaw.

By hydraulically displacing the hydraulic cylinder 10 relative to the hydraulic piston 9, the movable pressing jaw 25 is linearly displaced in the direction toward the fixed pressing jaw 26, for example to compress a pipe 28 with a fitting 29.

Longer pushing paths can be overcome with just one movable pressing jaw 26 by initially retaining the pressing jaw 26 in the receiving area 23, then performing a feed motion, and subsequently reinserting the pressing jaw 26 into the receiving area 24, after which compression can be completed.

Figure 6:
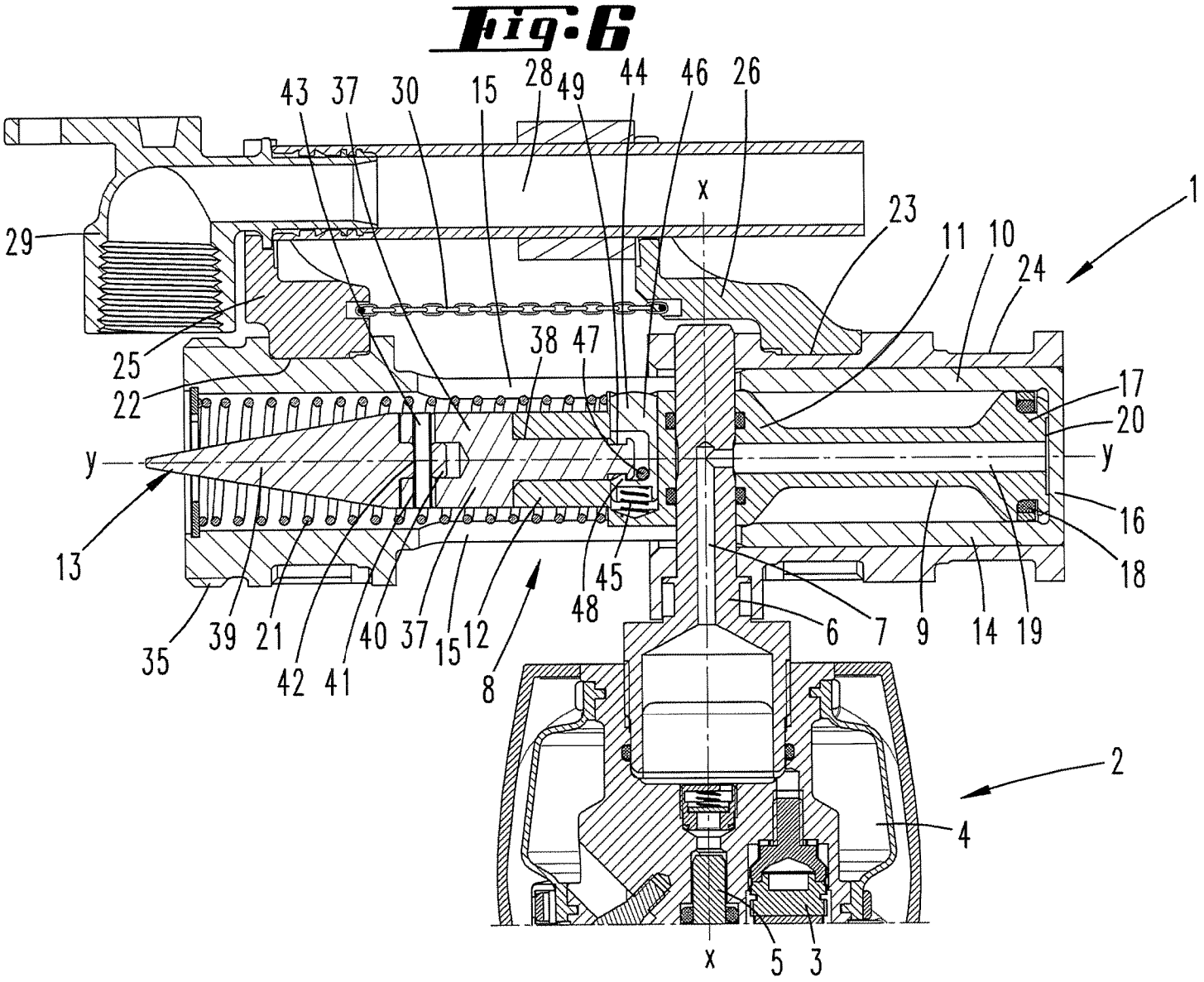
FIG. 6 Another illustration corresponding to FIG. 4 relating to a configuration of the pressing jaws for axial compression, in which the pressing jaws are connected with each other via a flexible connecting element.
Figure 1:
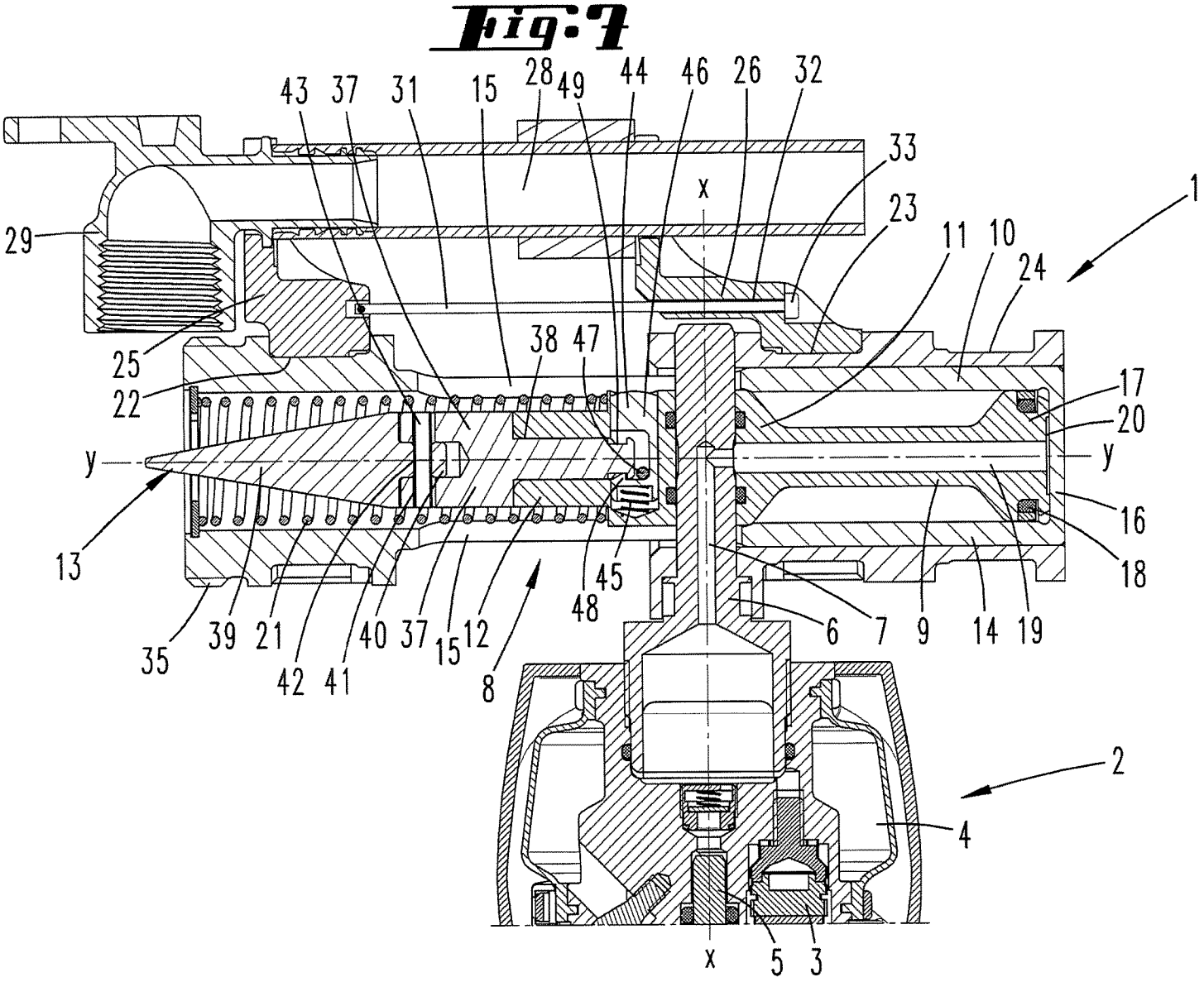
Figure 8:
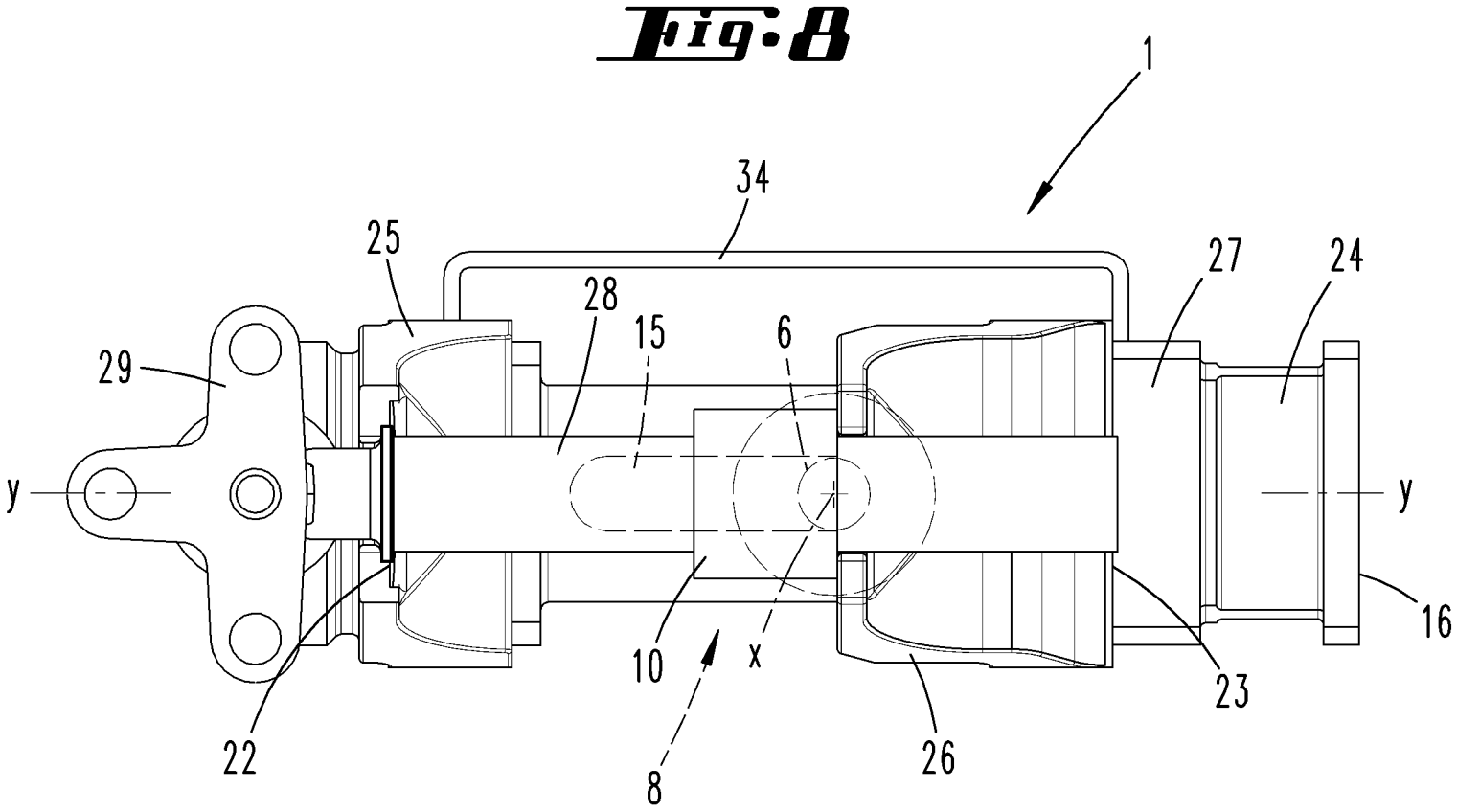
FIG. 8 An illustration corresponding to FIG. 2 relating to an alternative connection of the pressing jaws via a bracket.

As further schematically depicted on FIGS. 6 to 8, the pressing jaws 25, and 26 can be connected with each other so as to limit a movement apart when placed on the attachment 1. This connection potentially limits the spring-assisted return into a basic position of the attachment 1, i.e., the basic position of the attachment 1 provided by connecting the pressing jaws 25 and 26 need not necessarily be the usual basic position of the attachment 1 according to FIG. 4. The length selected for the connecting element between the pressing jaws 25 and 26 is preferably such that the maximum clearance between the pressing jaws 25 and 26 as viewed in the direction of the y axis is adjusted to the pressing jaw size.

Because the stop-limited return position of the attachment 1 might be reached earlier as a result of this connection than for the longitudinal slot-side stop in the area of the hydraulic cylinder 10, handling can be simplified. In addition, the entire device can potentially be prepared for a next compression process at an earlier time than when using the cylinder-side stop.

Once the stop position has been reached, the return valve 3 that opened during the return process automatically closes in the base device 2.

According to the illustration on FIG. 6, the connection between the pressing jaws 25 and 26 can also be provided by a flexible connecting element, for example a chain, a flexible rope such as a wire rope, or also a flexible plastic rope, which is slack but not elastic in terms of length.

The connecting element 30 is secured to both pressing jaws 25 and 26, or at least detachably fastened at one end.

According to the illustration on FIG. 7, the connection can also take the form of a rod 31. One end thereof can preferably be fastened to the movable pressing jaw 25, and preferably extends parallel to the y axis in the direction toward the other pressing jaw 26, penetrating through the latter in the area of a borehole 32 formed parallel to the y axis. The end of the rod 31 can be provided with a thickened area 33 that is enlarged by comparison to the diameter of the borehole 32 for interacting with a wall section of the pressing jaw 26 enveloping the borehole 32.

The connection can further be a bracket 34, as exemplarily illustrated on FIG. 8. This can be a roughly U-shaped bracket 34 with reference to the top view on FIG. 8, which can be secured to the pressing jaw 25 at one end, and can engage the pressing jaw 26 from behind at the other end with its free U-leg for stop-limited interaction with the pressing jaw 26.

Figure 9:
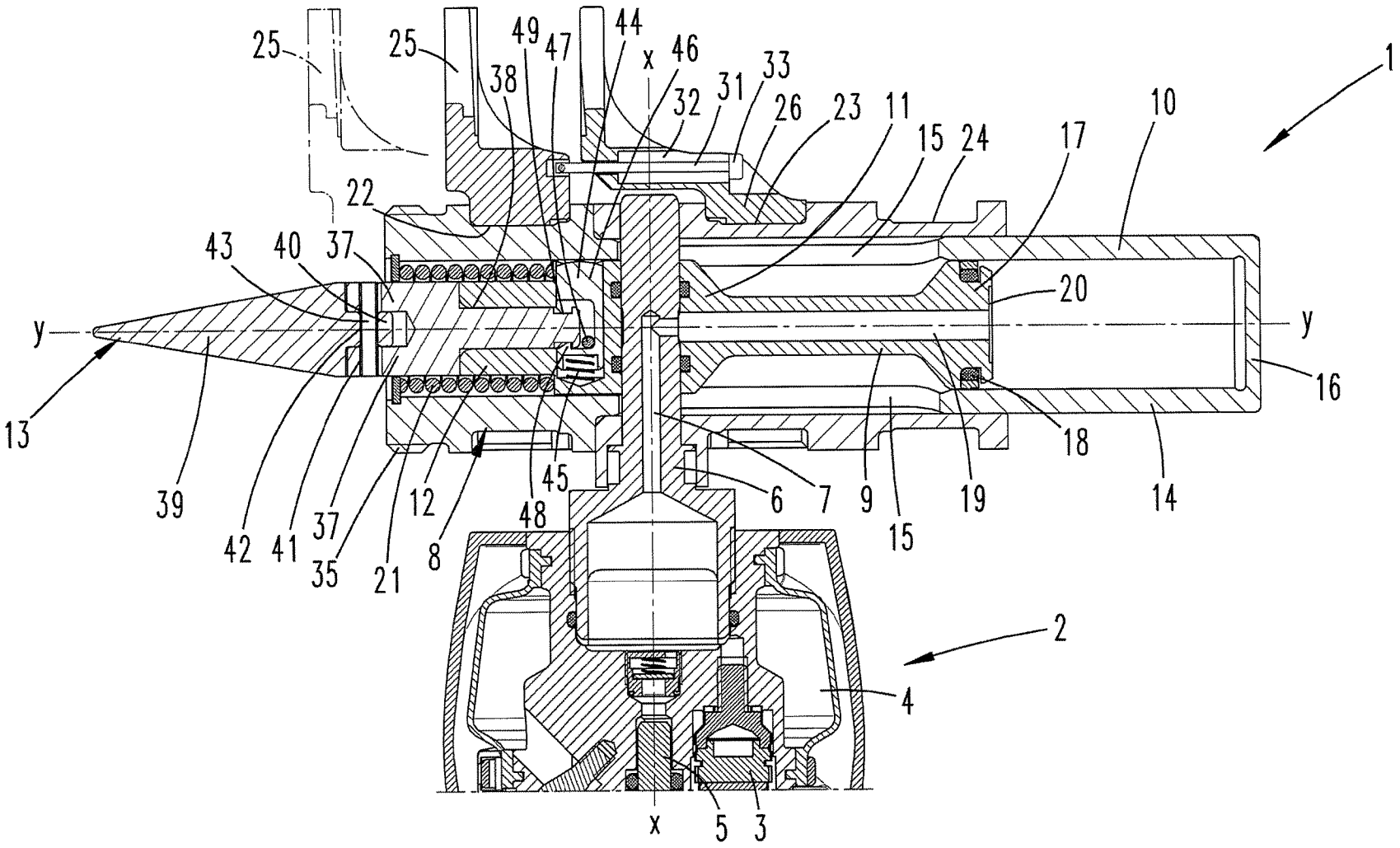
FIG. 9 An illustration essentially corresponding to FIG. 7 relating to another embodiment of the connection.

In another embodiment according to the illustration on FIG. 9, the assembly selected can have a rod 31 formed out of a wire having a length that results in an elongation of the free end of the rod 31 preferably provided with the thickened area solely or essentially in the penetration area of the one fixed pressing jaw 26. In the closed position of the pressing jaw (also depicted), the free end does not outwardly protrude.

The maximum pressing jaw open position defined by the interaction between the thickened area 33 and floor of the borehole 32 is illustrated by dot-dashed lines.

In the area of its free end facing away from the hydraulic piston 9, the hydraulic cylinder 10 is further provided with a thread 35 on the exterior wall side. The latter is used to fix in place a schematically illustrated expanding device 36. This expanding device 36 is acted upon by the actuation cone 13 for expanding a pipe end.

The actuation cone 13 can consist of two parts. A first part here comprises a mounting foot part 37, which plunges into a borehole 38 of the mounting section 12 running coaxially to the y axis.

The second part 39 of the actuation cone 13 makes up the conical surface.

The second part 39 has a central mandrel 40 running coaxially to the y axis. It is nestled in a correspondingly designed frontal borehole of the mounting foot part 37.

The plug-in retainer between the second part 39 and mounting foot part 37 consists of a cotter pin 43 that extends transversely to the y axis, and penetrates through transverse boreholes 41, 42 of the mounting foot part 37 and second part 39 that were made to overlap in this position. The cotter pin 43 is preferably a locking pin, which permits a limited tolerance compensation in the axial direction.

The front surface of the conical second part 39 that envelops the mandrel 40 and faces the front wall of the mounting foot part 37 is spaced a distance apart from the front surface of the mounting foot part 37, if necessary with the washer or the like interspersed. This distance can measure one or several tenths of a millimeter up to one or two millimeters. This makes it possible to make a fine adjustment with a washer interspersed.

The mounting section 12 and actuation cone 13 both extend radially inside the return spring 21. They are correspondingly enveloped by the return spring.

The actuation cone 13 is latched to the mounting section 12.

To this end, a locking button 44 is provided in a one-sidedly open radial borehole of the mounting section 12, the end of which that passes through the radial opening offers a handling surface.

Provided opposite this activating surface in the radial borehole is a compression spring 45, which tends to bias the locking button 44 radially outward through the borehole opening.

The locking button 44 has a pot-shaped latch receiver 46 that opens in an axial direction. A collet pin 47 that extends transverse to the direction of displacement of the locking button 44 and dipping into the material of the mounting section 12 at the respective end side penetrates through the latter, and offers a stop limit for the locking button 44 in the direction of spring action. In addition, the collet pin 47 secures the locking button 44 against rotation.

A latch projection 48 protruding radially inward in relation to the y axis is provided in the opening area of the latch receiver 46, so as to interact with a continuous latch groove 49 formed at the end side of the mounting foot part 37.

By using pressure to displace the locking button 44 against the force of the compression spring 45, the latch projection 48 can be disengaged from the latch groove 49, after which the actuation cone 13 as a whole can be pulled out of the hydraulic cylinder 10.

Figure 5:
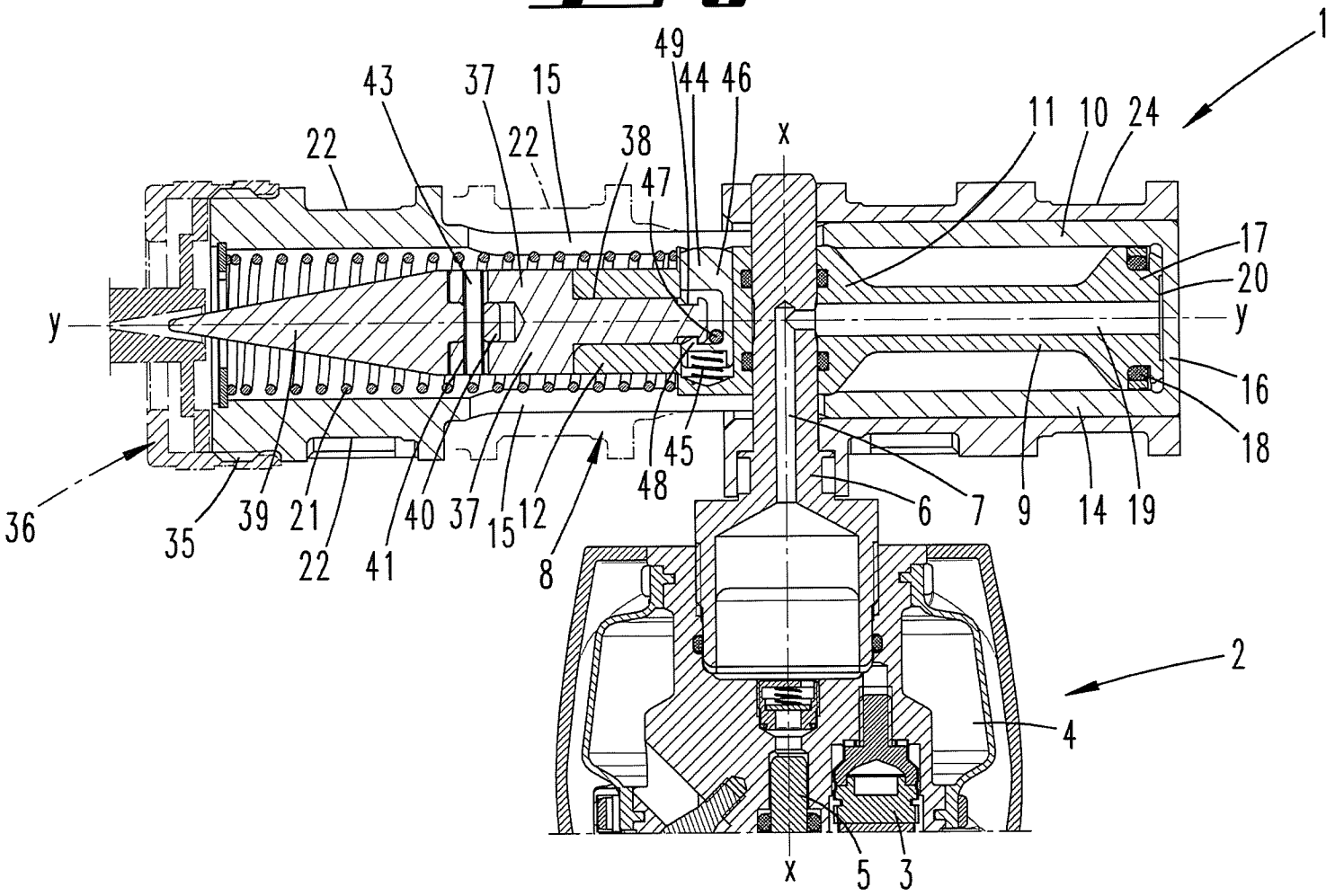
FIG. 5 A sectional view according to FIG. 4 relating to the attachment being used with an expanding device.

In the allocated position, the tip of the actuation cone 13 is arranged opposite the piston head 17 in relation to the stud x axis (see FIG. 5).

Hydraulically displacing the hydraulic cylinder 10 drags along the expanding device 36 in the direction toward the actuation cone 13. The latter thus emerges from the interior of the hydraulic cylinder 10 and dips into the expanding device 36.

The above statements serve to explain the inventions encompassed by the application as a whole, which also each independently further develop the prior art, at least via the following feature combinations, specifically:

A device, characterized in that the actuation cone 13 is connected with the hydraulic piston 9 of the hydraulic piston-cylinder assembly 8 for the forward and backward movement;

A device, characterized in that the hydraulic piston-cylinder assembly 8 is part of an attachment 1 that can be hooked up to a base device 2 for hydraulic supply purposes;

A device, characterized in that the piston-cylinder assembly 8 is secured to a mounting stud 6, which at the same time has a hydraulic line 7 for supplying the hydraulic piston-cylinder assembly 8;

A device, characterized in that the hydraulic piston-cylinder assembly 8 together with the pressing jaws 25, 26 can be rotated around the mounting stud 6;

A device, characterized in that the hydraulic piston 9 of the hydraulic piston-cylinder assembly 8 is fixed in place relative to the mounting stud 6 and/or base device 2 while activating the hydraulic piston-cylinder assembly 8;

A device, characterized in that actuation cone 13 can also be fixed in place relative to the mounting stud 6 and/or base device 2 while activating the hydraulic piston-cylinder assembly 8;

A device, characterized in that a piston head 17 of the hydraulic piston 9 exposed to hydraulic fluid during an activation is arranged opposite a free tip of the actuation cone 13 with respect to a longitudinal extension of the hydraulic piston 9 in the displacement direction of the hydraulic cylinder 10 of the hydraulic piston-cylinder assembly 8;

A device, characterized in that the actuation cone is detachably arranged in the device by way of a latching retainer;

A device, characterized in that a return spring 21 is provided for restoring the hydraulic piston-cylinder assembly 8, wherein the actuation cone 13 preferably extends over at least a portion of its longitudinal extension inside of the return spring 21;

A device, characterized in that the actuation cone 13 has a two-part design, wherein a first part is a mounting foot part 37, and a second part 39 has the conical surface;

A device, characterized in that three receiving areas 22 to 24 for pressing jaws 25, 26 arranged linearly one behind the other are provided;

A device, characterized in that two receiving areas 23, 24 are arranged linearly one behind the other on a fixed housing section 27 of the device, and one receiving area 22 on a hydraulic cylinder 10 that receives a hydraulic piston 9 of a piston-cylinder assembly 8;

A device, characterized in that the pressing jaws 25, 26 are joined together to limit any movement apart in the mounted state;

A device, characterized in that the connection is provided by a flexible connecting element 30;

A device, characterized in that the connection is provided by a rod 31;

A device, characterized in that the pressing jaws 25, 26 are not connected when in a removed state;

All disclosed features are essential to the invention (whether taken individually or in combination with each other). The disclosure of the application hereby also incorporates the disclosure content of the accompanying/attached priority documents in its entirety (copy of the prior application), even for the purpose of also including features from these documents in claims of the present application. The features in the subclaims characterize independent inventive further developments of prior art, in particular so as to generate partial applications based upon these claims.

REFERENCE LIST

| | |
|---|---|
| 1 | Attachment |
| 2 | Base device |
| 3 | Return valve |
| 4 | Tank |
| 5 | Pumping plunger |
| 6 | Mounting stud |
| 7 | Hydraulic line |
| 8 | Piston-cylinder assembly |
| 9 | Hydraulic piston |
| 10 | Hydraulic cylinder |
| 11 | Hub |
| 12 | Mounting section |
| 13 | Actuation cone |
| 14 | Cylinder wall |
| 15 | Longitudinal slot |
| 16 | Cylinder floor |
| 17 | Piston head |
| 18 | Gasket |
| 19 | Line |
| 20 | Pressure chamber |
| 21 | Return spring |
| 22 | Receiving area |
| 23 | Receiving area |
| 24 | Receiving area |
| 25 | Pressing jaw |
| 26 | Pressing jaw |
| 27 | Housing section |
| 28 | Pipe |
| 29 | Fitting |
| 30 | Connecting element |
| 31 | Rod |
| 32 | Borehole |
| 33 | Thickened area |
| 34 | Bracket |
| 35 | Thread |
| 36 | Expanding device |
| 37 | Mounting foot part |
| 38 | Borehole |
| 39 | Second part |
| 40 | Mandrel |
| 41 | Borehole |
| 42 | Borehole |
| 43 | Collet pin |
| 44 | Locking button |

-continued

| REFERENCE LIST | |
|---|---|
| 45 | Compression spring |
| 46 | Latch receiver |
| 47 | Collet pin |
| 48 | Latch projection |
| 49 | Latch groove |
| a | Arrow |
| x | Stud axis |
| y | Axis |

The invention claimed is:

1. A device configured to apply a pressing force to a workpiece, the device comprising:

a housing having first and second pressing jaw receiving areas;

a hydraulic piston-cylinder assembly movably mounted in the housing, the hydraulic piston-cylinder assembly having a third pressing jaw receiving area;

a first pressing jaw configured to be mounted in either of the first and second pressing jaw receiving areas; and a second pressing jaw mounted in the third pressing jaw receiving area, wherein the pressing jaws are configured to engage with the workpiece during an actuation of the hydraulic piston-cylinder assembly, wherein the first, second and third receiving areas are arranged linearly one behind the other.

2. A device configured to apply a pressing force to a workpiece, the device comprising:

a housing;

a hydraulic piston-cylinder assembly mounted in the housing, the hydraulic piston-cylinder assembly including a hydraulic cylinder being movable relative to the housing, and a hydraulic piston movably mounted within the hydraulic cylinder, the hydraulic piston being affixed to the housing;

a first pressing jaw mounted on the housing and fixed in place relative to the housing;

a second pressing jaw mounted on the hydraulic cylinder and fixed in place relative to the hydraulic cylinder, wherein the pressing jaws are configured to engage with the workpiece during an actuation of the hydraulic piston-cylinder assembly;

an actuation cone connected to the hydraulic piston for movement with the hydraulic piston, the actuation cone configured to engage with an expanding device;

wherein the housing and the hydraulic piston move relative to each other in a linear forward and backward movement upon actuation of the hydraulic piston-cylinder assembly.

3. The device according to claim 2, wherein the hydraulic piston-cylinder assembly is part of an attachment that can configured to be connected to a base device which supplies hydraulic fluid.

4. The device according to claim 3, wherein the hydraulic piston-cylinder assembly is secured to a mounting stud having a hydraulic line configured to supply hydraulic fluid to the hydraulic piston-cylinder assembly.

5. The device according to claim 4, wherein the hydraulic piston is fixed in place relative to the mounting stud and/or base device while activating the hydraulic piston-cylinder assembly.

6. The device according to claim 4, wherein the actuation cone is fixed in place relative to the mounting stud and/or base device while activating the hydraulic piston-cylinder assembly.

7. The device according to claim 2, wherein a piston head of the hydraulic piston exposed to hydraulic fluid during an activation of the hydraulic piston-cylinder assembly is arranged opposite a free tip of the actuation cone with respect to a longitudinal extension of the hydraulic piston in a displacement direction of the hydraulic cylinder.

8. The device according to claim 2, wherein the actuation cone is detachably attached to the hydraulic piston by a latch.

9. The device according to claim 2, further comprising a return spring mounted within the hydraulic cylinder which is configured to restore the hydraulic piston-cylinder assembly, wherein the actuation cone extends through at least a portion of the return spring.

10. The device according to claim 2, wherein the actuation cone includes a mounting foot part, and a part having a conical surface.

11. The device according to claim 2, wherein the pressing jaws are joined together by a connection which limits movement of the second pressing jaw relative to the first pressing jaw.

12. The pressing jaws according to claim 11, wherein the connection is a flexible connecting element.

13. The pressing jaws device according to claim 11, wherein the connection is a rod.

14. A device configured to apply a pressing force comprising:

a hydraulic piston-cylinder assembly which is part of an attachment configured to be connected to a base device which supplies hydraulic fluid, the hydraulic piston-cylinder assembly including a hydraulic piston;

a mounting stud having a hydraulic line configured to supply hydraulic fluid to the hydraulic piston-cylinder assembly, wherein the hydraulic piston-cylinder assembly is secured to the mounting stud;

two pressing jaws configured to be moved linearly relative to each other via the hydraulic piston-cylinder assembly;

an actuation cone configured to be attached to an expanding device and performs a forward and backward movement depending on the actuation of the hydraulic piston-cylinder assembly, wherein the actuation cone is connected with the hydraulic piston of the hydraulic piston-cylinder assembly for the forward and backward movement; and wherein the hydraulic piston-cylinder assembly and the pressing jaw can be jaws are configured to be rotated around the mounting stud.

* * * * *